US007752995B2

(12) United States Patent
Tremblay et al.

(10) Patent No.: US 7,752,995 B2
(45) Date of Patent: Jul. 13, 2010

(54) SLOT-COATING APPARATUS

(75) Inventors: Denis Tremblay, Pointe-aux-Trembles (CA); Jean-Claude Tremblay, Pointe-aux-Trembles (CA)

(73) Assignee: Johnson & Johnson Inc., Montreal, Quebec (CA)

( * ) Notice: Subject to any disclaimer, the term of this patent is extended or adjusted under 35 U.S.C. 154(b) by 541 days.

(21) Appl. No.: 11/751,690

(22) Filed: May 22, 2007

(65) Prior Publication Data

US 2008/0289572 A1 Nov. 27, 2008

(51) Int. Cl.

| | |
|---|---|
| ***B05B 15/04*** | (2006.01) |
| ***B05C 5/00*** | (2006.01) |
| ***A62C 31/00*** | (2006.01) |
| ***B65C 11/00*** | (2006.01) |

(52) U.S. Cl. ..... 118/301; 118/325; 118/410; 118/419; 239/436; 156/578

(58) Field of Classification Search ..... 118/301, 118/325, 406, 410, 419, 304, 211–212; 239/436, 239/437, 440, 556, 568; 425/382.4, 463; 156/578, 440; 427/350, 280, 282; 162/109, 162/135, 139

See application file for complete search history.

(56) References Cited

U.S. PATENT DOCUMENTS

| | | | | |
|---|---|---|---|---|
| 4,411,614 | A | 10/1983 | Feathers | |
| 4,465,544 | A | 8/1984 | Fischer et al. | |
| 4,844,002 | A | 7/1989 | Yasui et al. | |
| 4,871,593 | A | 10/1989 | McIntyre | |
| 4,968,534 | A | 11/1990 | Bogardy | |
| 5,225,240 | A | 7/1993 | Reichelt et al. | |
| 5,342,484 | A * | 8/1994 | Cutright et al. | 162/139 |
| 5,360,516 | A | 11/1994 | Cutright et al. | |
| 6,127,595 | A | 10/2000 | Makoui et al. | |
| 6,464,785 | B1 | 10/2002 | Puffe | |
| 6,531,025 | B1 | 3/2003 | Lender et al. | |
| 6,531,027 | B1 | 3/2003 | Lender et al. | |
| 6,533,765 | B1 | 3/2003 | Blaney et al. | |
| 2003/0000464 | A1 | 1/2003 | Puffe | |
| 2003/0088227 | A1 | 5/2003 | Schneider et al. | |
| 2003/0091736 | A1 * | 5/2003 | Zschaeck | 427/207.1 |
| 2003/0125688 | A1 | 7/2003 | Keane et al. | |
| 2003/0215658 | A1 | 11/2003 | Bermel | |
| 2004/0012112 | A1 | 1/2004 | Davidson et al. | |

FOREIGN PATENT DOCUMENTS

| | | | |
|---|---|---|---|
| EP | 0 286 755 | B1 | 3/1995 |
| EP | 0 643 928 | B1 | 4/1995 |
| EP | 0 598 559 | B1 | 1/1997 |
| WO | WO 96/38114 | | 12/1996 |

* cited by examiner

*Primary Examiner*—Yewebdar T Tadesse

(57) ABSTRACT

An apparatus for surface-to-surface application of a liquid media to a substrate. The apparatus comprises a housing and a device movably mounted within the housing. The housing has an external surface and an outlet. The device has an outer surface and an inner cavity for receiving the liquid media. The outer surface includes at least one recess in flow communication with the inner cavity such that liquid media can be delivered from the inner cavity to the recess. As the device moves within the housing, the at least one recess periodically passes by the outlet such as to apply to a substrate being conveyed past the outlet, in surface-to-surface contact with the external surface of the housing, a liquid media in a pattern corresponding in shape to the recess.

8 Claims, 14 Drawing Sheets

SLOT-COATING APPARATUS

FIELD OF THE INVENTION

The present invention relates to the field of slot-coating machines for applying a liquid media to a substrate of material, and specifically to a method and apparatus for slot-coating an adhesive onto a substrate that is to be incorporated into a sanitary absorbent article

BACKGROUND OF THE INVENTION

In general, the construction of sanitary absorbent articles, such as panty liners, diapers, incontinence articles and sanitary napkins, includes a body-facing layer, a garment-facing layer and an absorbent core positioned between the two. These different layers are kept together in a variety of different manners such as via crimping, thermal bonding and/or adhesive positioned between the layers. In the case of panty liners, incontinence articles and sanitary napkins, the garment-facing surface of these articles also includes a positioning adhesive thereon for securing the sanitary absorbent article to a wearer's undergarment.

Traditional manners of applying bonding adhesive between the different layers of material, or applying positioning adhesive to the garment facing surface of the napkin, involve either applying the adhesive via a printing operation (i.e. via contact deposition) or via a spraying operation. In the case of positioning adhesive, the adhesive can be applied either to the material of the garment facing surface directly, or to a release paper that transfers the positioning adhesive to the garment facing surface when the two are put into communication with each other. Each of these traditional methods of applying adhesive have numerous deficiencies, some of which will be described below.

For example, devices that print adhesive onto a substrate via contact deposition generally include a printing roll that includes indentations thereon for receiving adhesive to be printed onto the substrate. As the substrate moves past the printing roll, the adhesive contained within the indentations of the printing roll is printed onto the substrate via contact deposition. Unfortunately, a common deficiency with such printing devices is that in order to maintain the adhesive in a state wherein it can easily be printed onto a substrate, the printing roll is kept at a relatively high temperature. Often, the substrates of material that are to be incorporated into a sanitary absorbent article are quite fragile and delicate and are thus often damaged (i.e. melted) when the substrate moves past the heated printing roll. This results in damaged materials, and the need to shut down the printing device until a new substrate can be passed through the printing machine.

In order to avoid the deficiencies with such printing devices, another method of applying adhesive to a substrate is to use a spraying device, that sprays adhesive onto a substrate. However, a deficiency with devices used to spray adhesives onto substrates for sanitary absorbent articles, is that the adhesive cannot be continuously applied in accordance with complex shapes and patterns. Instead, the devices that spray adhesive onto a substrate simply apply the adhesive in accordance with a matrix of dots and/or lines. Given the asymmetric, often curved shape of many sanitary absorbent articles currently being manufactured today, this manner of applying adhesive is not able to apply sophisticated non-uniform, and often non-linear patterns of adhesive onto many sanitary absorbent articles.

Traditionally, sanitary absorbent articles (excluding diapers) have been secured to a wearer's undergarment. In many cases, however, it is desirable to adhere the absorbent article directly to a wearer's skin instead of to the wearer's undergarment. In order to adhere the absorbent article directly to a wearer's skin, a complex, non-linear pattern of adhesive is required on the body-facing layer of the material. Unfortunately, traditional methods and apparatuses for applying adhesive have not been able to achieve the shapes and or patterns of adhesive that would be required in order to adhere a sanitary absorbent article directly to a wearer's skin.

In the context of the above, it can be appreciated that there is a need in the industry for a method and apparatus for applying bonding and/or positioning adhesive to a substrate that allows complex shapes and or patterns of adhesive to be applied to the substrate while alleviating, at least in part, the deficiencies associated with the existing methods and devices.

SUMMARY OF THE INVENTION

In accordance with a first broad aspect, the present invention provides an apparatus for surface-to-surface application of a liquid media to a substrate The apparatus comprises a housing and a device movably mounted within the housing. The housing has an external surface and an outlet. The device has an outer surface and an inner cavity for receiving the liquid media. The outer surface includes at least one recess in flow communication with the inner cavity such that liquid media can be delivered from the inner cavity to the recess. As the device moves within the housing, the at least one recess periodically passes by the outlet such as to apply to a substrate being conveyed past the outlet in surface to surface contact with the external surface of the housing a liquid media in a pattern corresponding in shape to the recess.

In accordance with a second broad aspect, the present invention provides a method for surface-to-surface application of a liquid media to a substrate. The method comprises providing an apparatus that includes a housing and a device movably mounted within the housing. The housing has an external surface and an outlet. The device has an inner cavity for receiving a liquid media and an outer surface. The outer surface has at least one recess in flow communication with the inner cavity such that liquid media can be delivered from the inner cavity to the recess. The method further comprises conveying a substrate past the outlet of said housing such that the substrate is in surface-to-surface contact with the external surface of the housing, and moving the device within the housing such that the at least one recess periodically passes by the outlet of the housing thereby causing the liquid media to be applied to the substrate passing by the outlet in a pattern corresponding in shape to the recess.

In accordance with a third broad aspect, the present invention provides a method for manufacturing a sanitary absorbent article. The method comprising providing an apparatus that includes a housing and a device movably mounted within the housing. The housing has an external surface and an outlet. The device has an inner cavity for receiving a liquid media and an outer surface. The outer surface has at least one recess in flow communication with the inner cavity such that liquid media can be delivered from the inner cavity to the recess. The method further comprises conveying a substrate past the outlet of the housing such that the substrate is in surface-to-surface contact with the external surface of the housing, moving the device within the housing such that the at least one recess periodically passes by the outlet of said housing thereby causing the liquid media to be applied to the substrate passing by the outlet in a pattern corresponding in shape to the recess, and incorporating the substrate as a layer of a sanitary absorbent article.

In accordance with a fourth broad aspect, the present invention provides a method for manufacturing a sanitary absorbent article. The method comprises passing a substrate in surface-to-surface contact with a slot-coater along a slot-coating direction; the slot-coater having an outlet. The method further comprises exuding adhesive from the outlet such that the adhesive is applied on the substrate according to adhesive pattern as a result of the surface-to-surface contact. The adhesive pattern has at least one continuous block of adhesive that has a boundary. A line segment of the boundary being non-parallel to the slot-coating direction. The method further comprises completing the manufacture of the sanitary absorbent article including integrating in the sanitary absorbent article at least a portion of the substrate that includes adhesive.

In accordance with a fifth broad aspect, the present invention provides a sanitary absorbent article, comprising at least one layer slot-coated with a layer of adhesive, the layer of adhesive being deposited on the layer according to an adhesive pattern. The adhesive pattern being characterized by a slot-coating direction and including at least one continuous block of adhesive. The continuous block of adhesive having a boundary. A line segment of the boundary being non-parallel to the slot-coating direction.

These and other aspects and features of the present invention will now become apparent to those of ordinary skill in the art upon review of the following description of specific embodiments of the invention and the accompanying drawings.

BRIEF DESCRIPTION OF THE DRAWINGS

A detailed description of examples of implementation of the present invention is provided hereinbelow with reference to the following drawings, in which.

Figure 1:
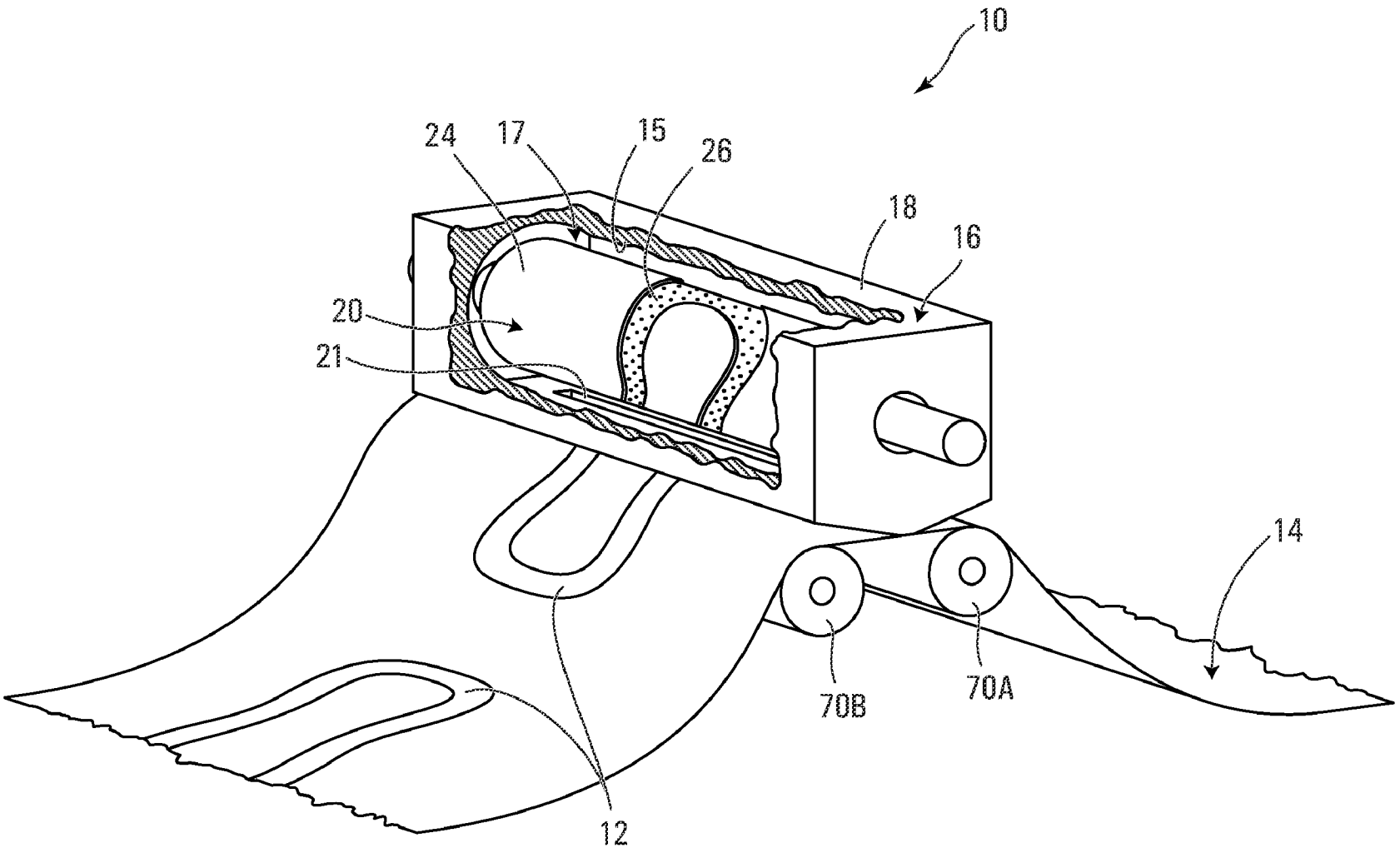
FIG. 1 shows a perspective view of a slot-coating apparatus in accordance with a non-limiting example of implementation of the present invention, a portion of the slot-coating apparatus has been cut-away to show a movable device contained within the slot-coating apparatus.

In the drawings, embodiments of the invention are illustrated by way of example. It is to be expressly understood that the description and drawings are only for purposes of illustration and as an aid to understanding, and are not intended to be a definition of the limits of the invention.

DETAILED DESCRIPTION

Shown in FIG. 1 is a slot-coating apparatus 10 in accordance with a non-limiting example of implementation of the present invention. As will be described in more detail throughout the present application, the slot-coating apparatus 10 is operative for applying a liquid media 12 to a substrate 14 in accordance with a certain deposition pattern. For the purposes of the present description, the substrate 14 will be described as being a material that is suitable for being incorporated into a sanitary absorbent article, such as a sanitary napkin, a diaper, a panty liner or an incontinence article, among other possibilities, and the liquid media 12 will be described as being either a bonding adhesive or a positioning adhesive for use with the sanitary absorbent article. It should be appreciated, however, that the substrate could be any suitable substrate, such as a paper or a fabric substrate, and the liquid media could be any suitable liquid media, such as a lotion, ink and/or a perfume, without departing from the spirit of the invention.

Figure 2:
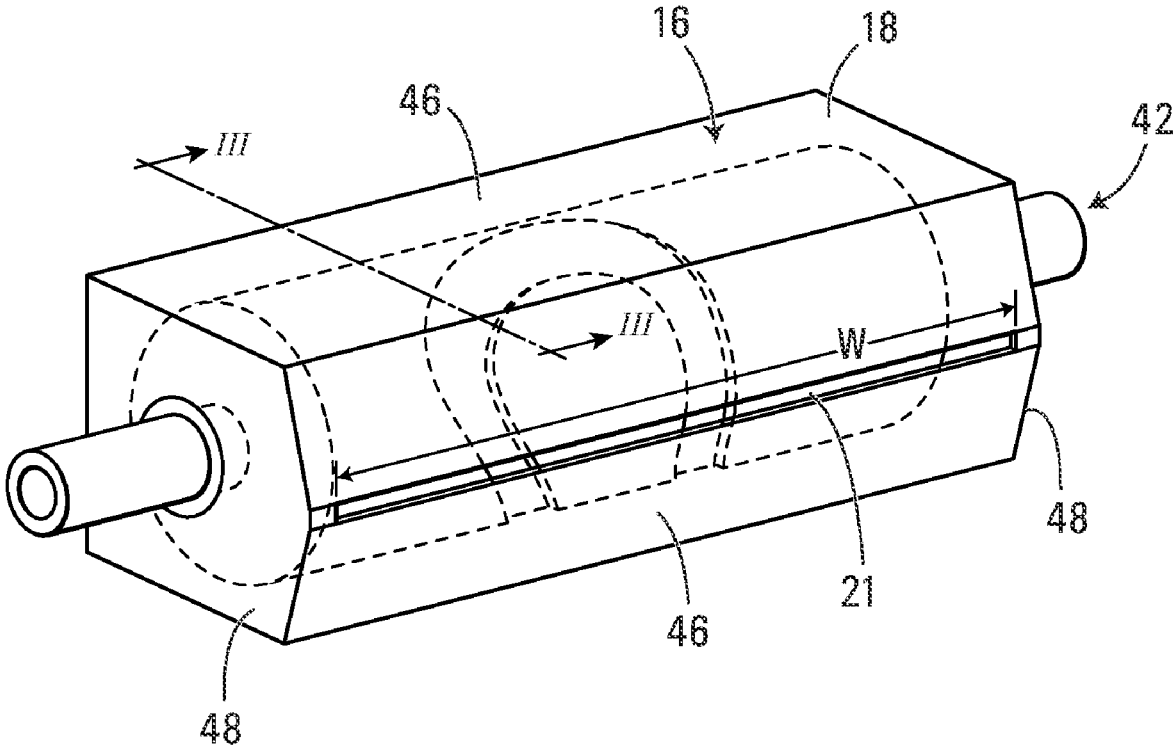
FIG. 2 shows a non-limiting example of an outer housing of the slot coating apparatus of FIG. 1, with the movable device shown in dotted lines.

As shown in FIGS. 1 and 2, the slot coating apparatus 10 of the present invention comprises a housing 16 and a device 20 that is rotatably mounted within the housing 16. The housing 16 includes an external surface 18 as well as an internal surface 15 that defines an internal chamber 17 in which is mounted the device 20. The housing 16 further includes a slot-shaped outlet 21 that extends from the internal surface 15 to the external surface 18 for allowing liquid media 12 to pass therethrough.

The movable device 20 includes an outer surface 24, an internal cavity 28 (shown in FIGS. 3, 5A and 5B) and at least one recess 26 formed in the outer surface 24. As shown in FIG. 3, the internal cavity 28 is in flow communication with a bottom surface 25 of the recess 26 via a plurality of through-bores 30. As such, adhesive contained within the internal cavity 28 of the movable device 20 is able to travel through the through-bores 30 into the recess 26. Once the adhesive 12 exits the through-bores 30 in the recess 26, the adhesive from each of the through-bores 30 blends together and pools within the recess 26.

As shown in FIGS. 1 and 3, during operation, the substrate 14 is conveyed past the outlet 21 of the slot coating apparatus 10 such that it passes in surface-to-surface contact with the external surface 18 of the housing 16. In addition, the movable device 20 contained within the internal chamber 17 of the housing 16 moves within the housing 16 such that the recess 26 also periodically travels past the outlet 21. The substrate 14 and the outer surface 24 of the movable device 20 move past the outlet 21, on respective different sides of the outlet 21, at substantially the same speed. Accordingly, as the movable device 20 moves within the housing 16, the recess 26 periodically passes by the outlet 21 such that adhesive 12 that has accumulated/pooled within the recess 26 exudes through the outlet 21. As the adhesive 12 exudes through the outlet 21, the substrate 14 moves past the outlet 21, such that the adhesive is applied onto the substrate 14. In other words, the substrate 14 wipes away the adhesive that has exuded through the outlet 21 to form a continuous block of adhesive on the substrate 14. Stated another way, the adhesive is applied to the substrate 14 due to the surface to surface contact of the substrate 14 with the external surface 18 of the housing 16.

It should be appreciated that at any point in time, the adhesive 12 that exudes through the outlet 21 is in the form of a line whose thickness (measure "H" in FIG. 3A) remains constant and whose length corresponds to the width of the portion of the recess 26 that currently faces the outlet 21. If the recess 26 has a non-constant width (as is the case with the embodiment shown in FIGS. 1 and 2), the width of the adhesive exudate at the outlet 21 will dynamically vary as the recess 26 slides past the outlet 21. The adhesive 12 that exudes out of the outlet 21 is applied to the substrate 14 as a result of the surface to surface contact with the outlet 21. The width of that adhesive pattern applied to the substrate 14 varies according to the width of the recess 26 and produces an adhesive deposition pattern that corresponds in shape to the shape of the recess 26.

The slot coating apparatus 10 and the method of applying liquid media to the substrate will now be described in more detail below.

Referring back to FIG. 2, in the non-limiting example of implementation shown, the exterior of the housing 16 of the slot coating apparatus 10 is substantially rectangular in shape, with four longitudinally extending walls 46 and two side walls 48. As shown in FIGS. 1 and 3, the internal chamber 17 of the housing 16 is substantially cylindrical in shape, such that the movable device 20 fits snugly therein. In accordance with a first embodiment, the clearance between the inner wall 15 of the cylindrical internal chamber 17 and the outer surface 24 of the movable device 20 is sufficient such that the movable device 20 is able to rotate within the chamber 17, but small enough such that adhesive that has pooled within the recess 26 is not able to leak out of the recess 26. In accordance with a second embodiment that will be described in more detail below, the recess 26 includes a gasket 64 around its outer edge. In such an embodiment, there may be a greater clearance between the inner wall 15 of the cylindrical internal chamber 17 and the outer surface 24 of the movable device 20 such that only the gasket 64 is in contact with the inner wall 15 of the cylindrical internal chamber 17. The gasket 64 thus forms a seal between the recess and the inner wall 15 of the internal chamber 17. In this manner, the gasket 64 prevents the adhesive from leaking out of the recess 26.

Although the housing 16 shown in the Figures is of a substantially rectangular, box-shape, it should be appreciated that the housing 16 can be of any shape that provides for an internal chamber 17 that surrounds the movable device 20. For example, the housing 16 may be of a cylindrical shape, or a semi-cylindrical shape, among other possibilities. Likewise, the internal chamber 17 can be of any suitable shape for enabling the movable device 20 to move therein, so long as a seal is formed between the inner wall 15 of the chamber 17 and the recess 26 of the movable device 20.

The housing 16 can be made of any suitable material that can support the movable device 20 and withstand heat applied to the different components of the slot-coating apparatus 10. For example, the housing 16 can be made of steel, or a composite material, among other possibilities. The four longitudinal walls 46 and the two side walls 48 can be assembled in any manner known in the art, such as via screws, rivets or any other mechanical fastener. Alternatively, the housing 16 can be welded together such that the walls are not detachable from each other. In yet a further alternative example, the housing 16 can be machined from a solid block of material, such that the walls 46 and 48 are formed from an integral piece of material.

As shown in FIGS. 1 and 2, the longitudinally extending wall 46 that includes the slot shaped outlet 21 therein, slants outwardly towards the slot shaped outlet 21. In this manner, as the substrate 14 moves past the slot shaped outlet 21, the two slanted portions of the longitudinally extending wall 46 act as a nozzle such that the substrate simply contacts the outlet 21. In the embodiment shown in the Figures, the slot-shaped outlet 21 is of a generally rectangular shape. However, an outlet 21 having another shape that allows the transfer of adhesive from the movable device 20 to the substrate 14 is also included within the scope of the present invention. For example, the slot-shaped outlet 21 may be of an oval shape, or a shallow diamond shape, among other possibilities.

Figure 3A:
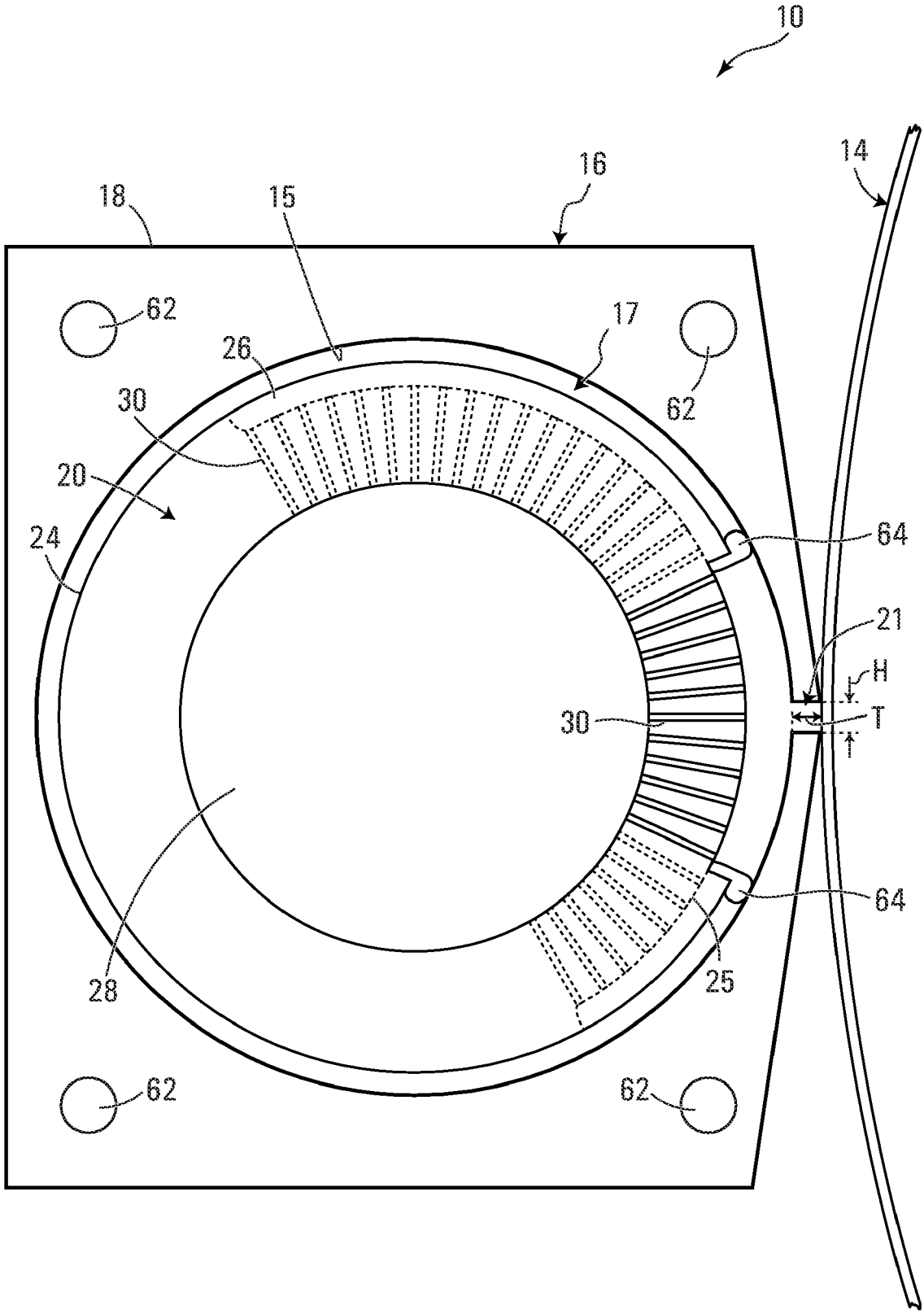
FIG. 3A shows a cross-sectional diagram of the slot-coating apparatus of FIG. 1, taken through plane III shown in FIG. 2.

In the embodiment shown in FIG. 3A, the slot-shaped outlet 21 has an even height H across the entire width of the slot 21. The height H of the slot-shaped opening 21 can be anywhere between 3-5 thousandths of an inch, and the width W of the slot-shaped opening 21 can be anywhere from 1" to the entire width of the housing. In an alternative embodiment, the height H of the slot-shaped outlet 21 can vary over the width W of the outlet 21, such as in the case where the slot 21 is of an elongated, shallow, diamond shape. In such an embodiment, the height of the slot would be greatest in the center of the outlet, and taper towards the two outer ends of the outlet. The thickness T of the outlet 21, as shown in FIG. 3A is quite small. In accordance with a non-limiting example, the thickness T is in the range of 1 mm-3 mm.

It should be appreciated that both the height H and thickness T of the slot-shaped opening 21 can be selected on the basis of the amount of adhesive to be applied to the substrate, and the viscosity of the adhesive. A person skilled in the art would be able to determine the optimal shape and size of the slot-shaped outlet depending on a variety of different factors. In a non-limiting embodiment of the present invention, the slot shaped opening 21 may be included within a removable section of the housing 16. As such, depending on the desired application of the adhesive, a different removable section can be incorporated into the housing 16, so as to change the dimensions and characteristics of the slot-shaped opening 21.

As described above, the movable device 20 is mounted within the housing 16 such that the recess 26 is able to periodically travel past the slot-shaped outlet 21. In the non-limiting embodiment shown in the Figures, the movable device 20 is in the shape of a hollow cylindrical roller that is rotatably mounted within the housing 16. In accordance with a non-limiting embodiment, the cylindrical roller can have a diameter of approximately 3.5-5.5 inches, however, it should be understood that any diameter is possible. For example, in the case where the cylindrical roller includes multiple deposition patterns, as will be described in more detail below, the cylindrical roller may have a larger diameter than that specified above.

The cylindrical roller can be mounted within the housing 16 via two shafts that each extend through the side walls 48 of the housing 16. The cylindrical roller is preferably rotated via an electric motor connected to gears and/or belts for causing the shafts to rotate. However, any suitable mechanism for causing the movable device 20 to rotate is included within the scope of the present invention.

Figure 3B:
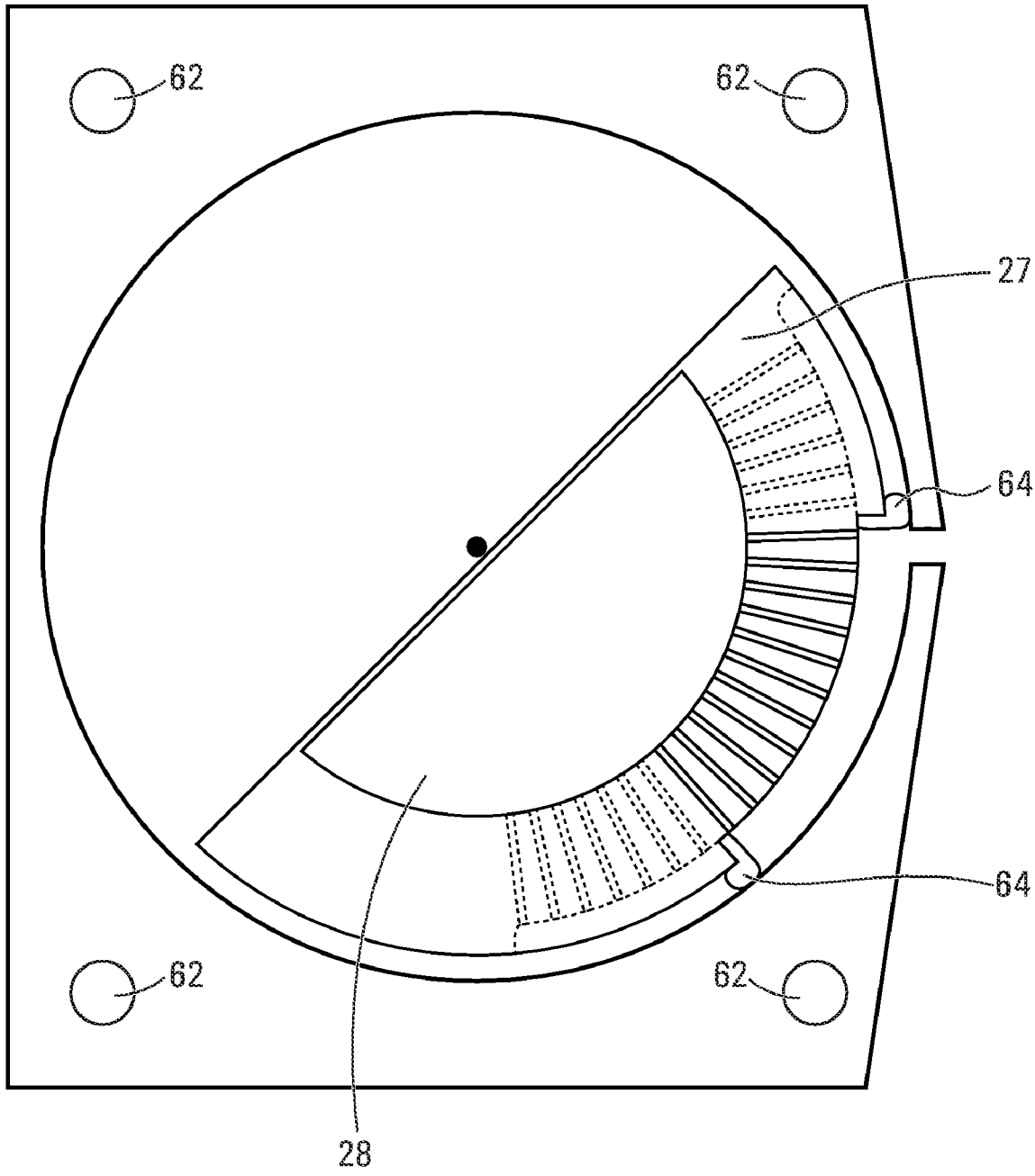
FIG. 3B shows a cross-sectional diagram of a non-limiting example of an alternative slot-coating apparatus in accordance with the present invention.
Figure 3C:
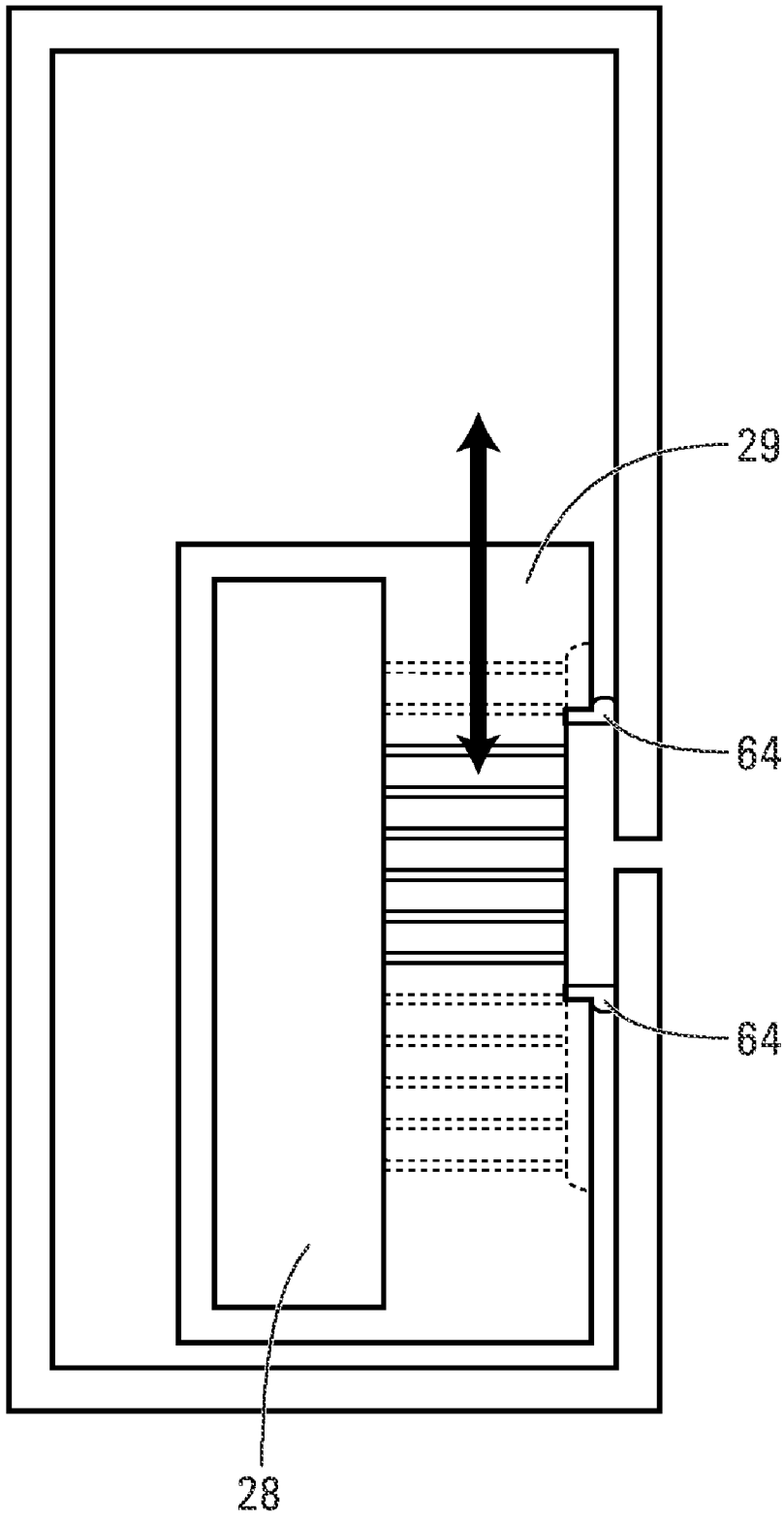
FIG. 3C shows a cross-sectional diagram of a non-limiting example of an alternative slot-coating apparatus in accordance with the present invention.
Figure 4:
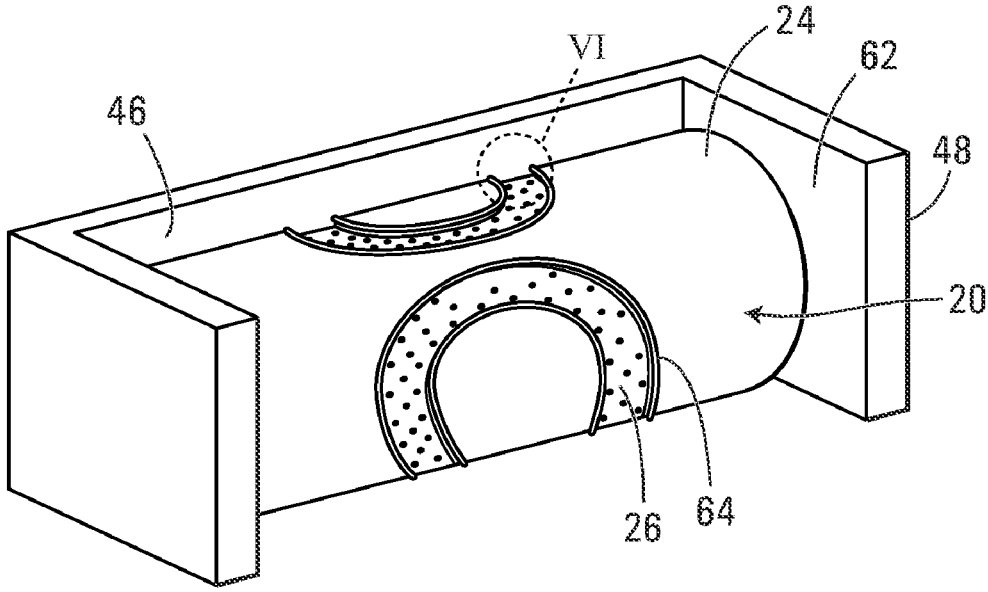
FIG. 4 shows a perspective view of the slot-coating apparatus of FIG. 1, with two walls of the housing removed.

In addition, although the movable device 20 shown in FIG. 3A is a cylindrical roller, it should be appreciated that the movable device 20 can be of any shape that allows a recess 26 contained in its outer surface 24 to periodically travel past the outlet 21. For example, the movable device 20 could be in the shape of a semi-cylindrical roller 27, as shown in FIG. 3B that rotates in complete revolutions within the housing 16. Alternatively, the semi-cylindrical roller 27 could move within the internal chamber 17 such that it only rotates by 180° past the slot-shaped outlet 21. In such an embodiment, the semi-cylindrical roller 27 would switch between rotation in a clockwise direction, and rotation in a counter clock-wise direction, such that it rotates back and forth against the slot 21. So long as the shape of the movable device 20 permits movement of a recess 26 past a slot-shaped outlet 21, the movable device 20 can be of any shape, size and configuration. For example, as shown in FIG. 3C, the movable device 20 may be a form of plate 29 that slides up and down (or side to side) against a slot-shaped opening 21.

In the non-limiting embodiment shown in FIGS. 1, 2, 3A and 8, the movable device 20 includes one recess 26 in its outer surface 24. It should, however, be appreciated that multiple recesses 26 can be included in the outer surface 24 of the movable device 20, without departing from the spirit of the invention. As will be described below, the recess, or recesses, included within the outer surface 24 of the movable device 20 correspond in shape to one or more deposition patterns of adhesive to be applied to a substrate. For the purposes of the present description, each deposition pattern is associated to a pattern of adhesive for a single sanitary absorbent article.

In the embodiment shown, wherein the movable device 20 includes only one recess 26, that recess corresponds to a single deposition pattern of adhesive to be applied to a substrate. As such for each revolution of the cylindrical roller, a single deposition pattern corresponding to a single sanitary absorbent article is applied to the substrate 14. In the case where the cylindrical roller includes two recesses that each correspond to a deposition pattern of adhesive for a respective sanitary absorbent article, with each revolution of the cylindrical roller, two deposition patterns of adhesive corresponding to two sanitary absorbent articles are applied to the substrate 14. In a further alternative example of implementation, the cylindrical roller could include a plurality of recesses, wherein the combination of two or more recesses creates a single deposition pattern corresponding to a pattern of adhesive for a single sanitary absorbent article.

As mentioned above, included in the bottom surface 25 of the recess 26 are a plurality of through-bores 30 that extend into the internal cavity 28 of the movable device 20 for permitting the adhesive to travel from the internal cavity 28 to the recess 26. It should be appreciated that the size and spacing of the through-bores 30 can vary depending on a variety of different factors, such as the viscosity of the adhesive and the desired rate at which the adhesive enters the recess 26, among other possibilities. A person of skill in the art would be able to determine the appropriate size and spacing of the through-bores 30 depending on the desired performance, and as such will not be described in more detail herein. In accordance with a non-limiting example of the present invention, the through-bores 30 have a diameter of between 1-3 mm, and are preferably spaced apart such that there are approximately 10-20 through-bores per square inch.

In accordance with a first example of implementation, the through-bores 30 are evenly spaced along the bottom surface 25 of the recess 26. However, in an alternative example of implementation, the through-bores 30 are not uniformly distributed over the bottom surface of the recess, and instead are distributed such that the through-bore density varies within different regions of the recess 26. For example, in a portion of the recess 26 to which adhesive cannot easily flow, such as in a sharply defined corner, the bottom surface 25 may include a higher density of through-bores 30 than in a more open area of the recess 26 into which the adhesive can easily flow.

Figure 6:
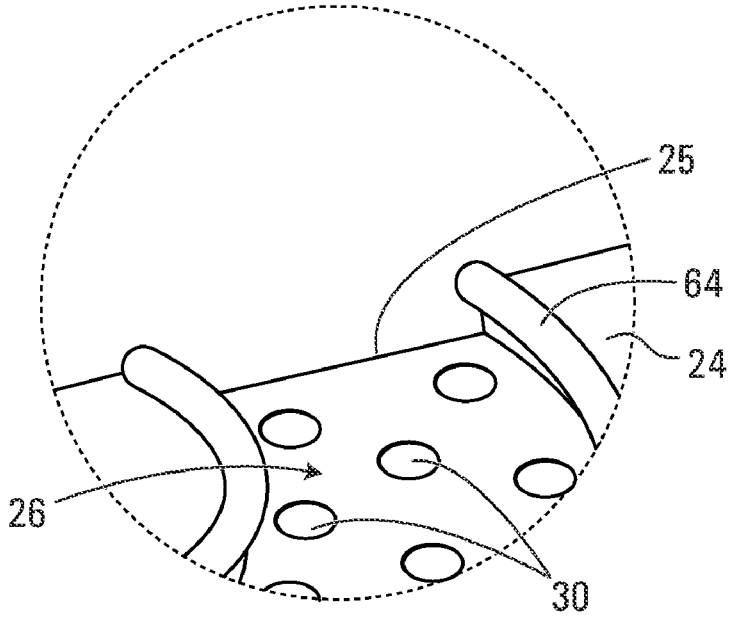
FIG. 6 shows an expanded view of the portion of the movable device contained in circle VI in FIG. 4.

The recess 26 included within the outer surface 24 of the movable device 20 includes edge portions that separate the recess 26 from the outer surface 24 of the movable device 20. As described above, in an optional embodiment, such as that shown in FIG. 6, positioned around the edge portions of the recess 26 are gaskets 64. The gaskets 64 extend above the outer surface 24 of the movable device 20 for preventing adhesive that has pooled within the recess 26 from leaking onto the outer surface 24 of the movable device 20. As such, the gaskets 64 ensure that the adhesive that travels from the internal cavity 28 to the recess 26 through the through-bores 30 stays within the recess 26. This helps to ensure that the deposition patterns of adhesive that are applied to the substrate have clearly defined edges. The gaskets 64 can be made of any malleable material, such as rubber, that is able to slightly compress. As shown in FIG. 3A, as the movable device 20 rotates, the gasket 64 abuts against the inside surface 15 of the longitudinally extending wall 46 that includes the slot 21, such that the gasket 64 forms a seal with the wall 46 thus keeping the adhesive that exudes through the slot between the edges of the recess 26.

Figure 5A:
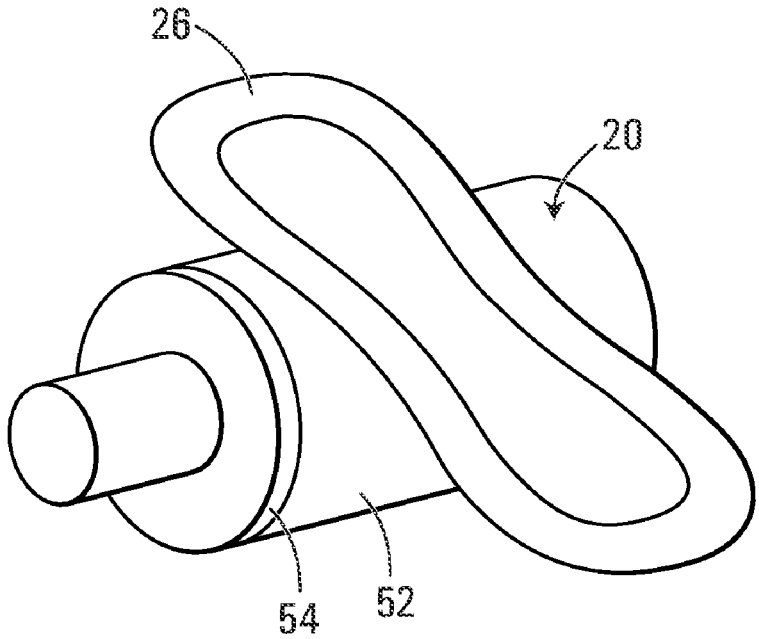
FIG. 5A shows a linear representation of the shape of a non-limiting recess to be included in the outer surface of the movable device of FIG. 1.
Figure 5B:
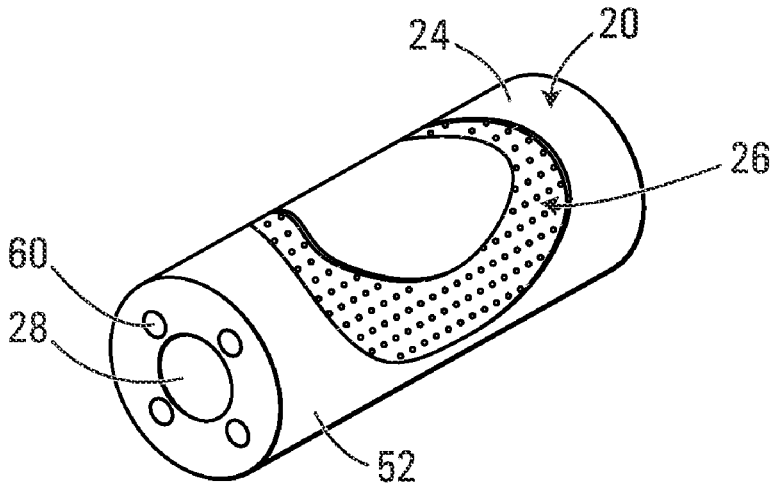
FIG. 5B shows the movable device with a recess included in its outer surface.

Shown in FIG. 5A is a linear representation of a recess 26 positioned above the movable device 20. When flat, the shape of the recess 26 corresponds to the shape of an adhesive deposition pattern to be applied to the substrate 14. FIG. 5B shows a perspective view of the movable device 20 when the recess 26 is included within the outer surface 24 of the movable device 20.

In a non-limiting example of implementation, the movable device 20 is a machined part that is formed from a solid block of material. As such, the recess 26 is machined into the outer surface 24 of the movable device 20 using an appropriate machining tool. The machining may be done manually, or via a CNC machine, among other possibilities.

As shown in FIGS. 5A and 5B, the movable device 20 can be made of multiple different materials. For example, the movable device 20 can include a tube portion 52, made of a material such as stainless steel or Lexan™ that provide the desired characteristics with respect to heat resistance and thermal conductivity. The movable device 20 may also include edge portions 54 that are made of stainless steel and connect the tube portion 52 of the movable device 20 to the shafts. As shown in FIG. 5B, the tube portion 52 includes bores 60 such that the outer edge portions 54 can be bolted to the tube portion 52. Although the movable device 20 shown in FIG. 5B is formed of two different parts which can have two different materials, it should be appreciated that the movable device 20 can be made of one solid piece of material, or any number of different layers of material, without departing from the spirit of the invention.

As shown in FIG. 3A, included within the body of the housing 16 are bores 62 for receiving heating elements. The purpose of the heating elements is to maintain the inside surface 15 of the housing 16 warm, such that the adhesive 12 that has pooled within the recess 26 of the movable device 20 remains hot. The heating elements thus help to maintain the adhesive within the recess 26 in a fluid state, such that the adhesive can exude through the slot shaped outlet 21 as the recess 26 passes by the outlet 21. The heating elements can be any type of heating elements, such as electrical heating rods, or hot water tubes through which hot water runs, among other possibilities. It should be appreciated that any number of bores 62 that include heating elements can be included within the housing 16, and that they can be positioned, configured and/or orientated in any manner, so long as adequate heating is provided for maintaining the adhesive in a fluid state.

Alternatively, in the case where the slot coating apparatus 10 is operative for applying lotion to a substrate instead of adhesive, it may be desirable to keep the body of the housing 16 relatively cold. In such an embodiment, the bores 62 can be used to receive cooling elements.

With reference back to FIG. 1, during operation of the slot coating apparatus 10, the substrate 14 of material is conveyed past the outlet 21 such that it is in surface-to-surface contact with the outlet 21 of the housing 16. In this manner, as the substrate passes by the outlet 21, it is able to wipe away the adhesive that has exuded through the slot shaped outlet 21. It should be appreciated that the manner in which the substrate 14 is conveyed past the apparatus 10 can be done in a variety of manners. For example, the substrate 14 can be conveyed past the slot-shaped outlet 21 of the apparatus 10 using a pair of small rollers 70*a* and 70*b*, as shown in FIG. 1, or in any other manner known in the art. The present invention is not limited to the manner in which the substrate 14 is conveyed past the apparatus 10.

Figure 7:
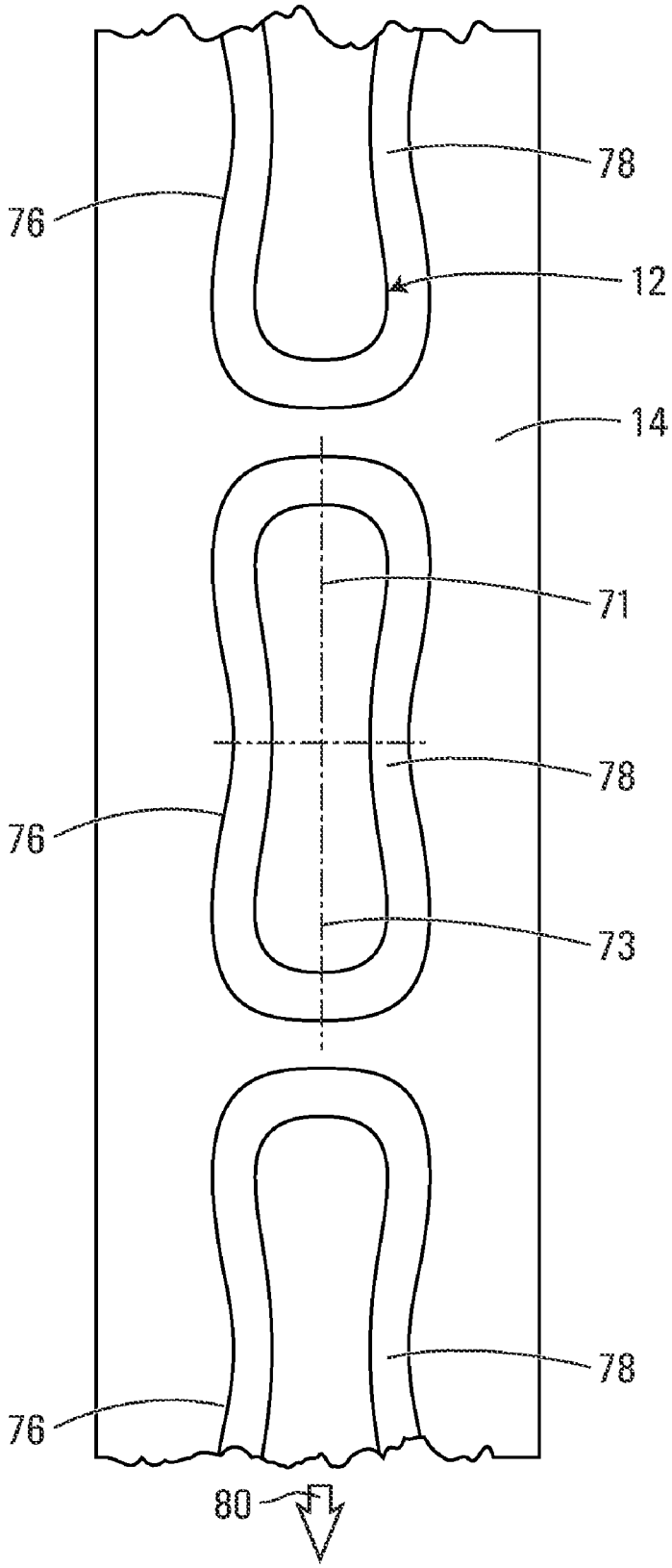
FIG. 7 shows a substrate of material having a non-limiting sequence of deposition patterns of adhesive included thereon.

As further shown in FIG. 1, the substrate 14 is conveyed past the apparatus 10 in a slot-coating direction. Generally speaking, the slot coating direction is the direction along which the substrate moves, and the direction along which deposition patterns of adhesive are applied by the slot-coating apparatus 10. Shown in FIG. 7 is a non-limiting example of a substrate 14 that has a plurality of deposition patterns 78 applied thereon. The slot coating direction is illustrated by arrow 80. Each deposition pattern 78 applied to the substrate 14 has a longitudinal axis 71 and a transverse axis 73. In the non-limiting embodiment shown, the slot coating direction 80 is parallel to the longitudinal axis 71 of the deposition pattern 78. However, in an alternative embodiment, the deposition patterns 78 may be applied to the substrate 14 in a side-by-side arrangement, instead of an end-to-end arrangement. In such an embodiment, the slot-coating direction 80 would be parallel to the transverse axis 73 of the deposition pattern 78.

As the substrate 14 moves in surface-to-surface contact with the slot-coating apparatus 10 along the slot-coating direction 80, the adhesive 12 from the apparatus 10 exudes through the slot-shaped outlet 21 and is applied onto substrate 14 to form a sequence of deposition patterns 78 thereon. Each deposition pattern 78 includes at least one continuous block of adhesive that, as shown in FIG. 7, has a boundary 76 with a line segment that is non-parallel to the slot-coating direction 80. In many cases, each deposition pattern 78 includes a continuous block of adhesive that has a non-linear boundary 76, such that the boundary 76 is curved or rounded. A benefit of the slot coating apparatus 10 of the present invention, is that it can apply a deposition pattern of adhesive 78 to a substrate 14 that includes a continuous block of adhesive having any shape and size. Many existing devices that are able to apply adhesive to different substrates are only able to apply the adhesive in straight lines or in patterns that are formed from a matrix of dots, as opposed to a continuous block of adhesive having a non-linear shape.

In accordance with a non-limiting embodiment, the adhesive, or other liquid media that is applied to the substrate 14 can include a coloring agent, such as ink, incorporated therein. As such, the deposition patterns of adhesive 78 that are applied to the substrate show a colored pattern that in some embodiments can be seen through two different layers of material when adhered together. This can provide a visually appealing look to any sanitary absorbent product that incorporates a substrate 14 to which a deposition pattern of liquid media has been applied in accordance with the present invention.

Figure 8:
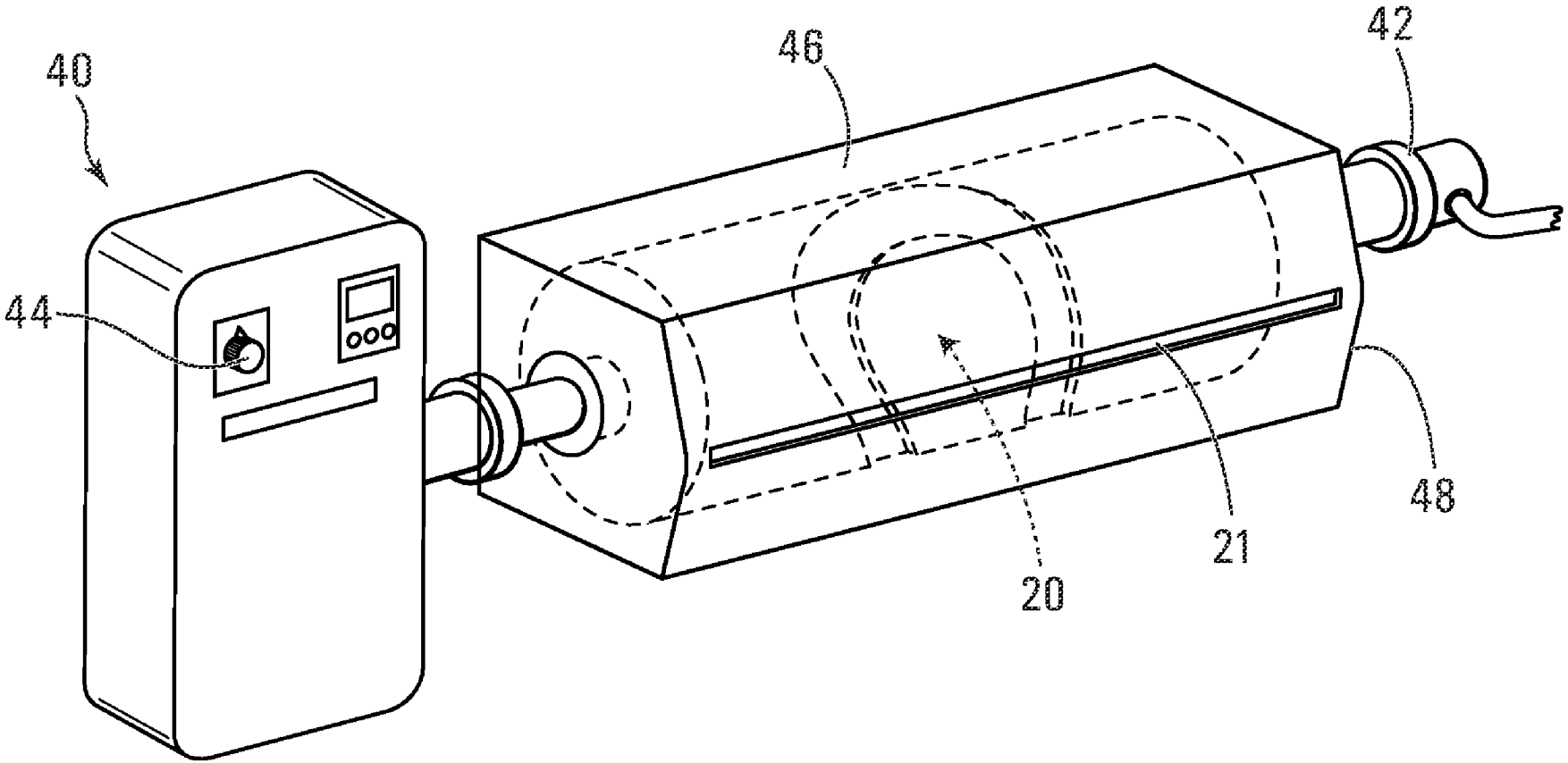
FIG. 8 shows the slot coating apparatus of FIG. 1 in communication with a control system and a liquid media supply, in accordance with a non-limiting example of implementation of the present invention.

As shown in FIG. 8, during operation, the slot coating apparatus 10 is connected to a control system 40 and an adhesive supply (not shown). The adhesive supply is connected to an inlet 42 such that adhesive can be supplied to the internal cavity 28 of the movable device 20. Typically, the supply of adhesive is controlled by an external adhesive meter and pump.

The control system 40 is operative for controlling the electrical power supplied to the apparatus 10, and for controlling various operational settings of the apparatus 10. For example, the control system 40 may be operative for controlling the temperature of the housing 16. The speed of the movable device 20 is controlled by a general control system for the production line such that the rotation of the movable device 20 is consistent with the speed of movement of the substrate 14.

In the non-limiting embodiment shown, the control system 40 includes a user operable input 44, which in the embodiment shown is a knob. It should be appreciated that the user operable input 44 could also be a dial, one or more buttons and/or keypads, among other possibilities, for enabling a user to enter commands for controlling the apparatus 10.

The control system 40 may be a dedicated device for controlling only the slot-coating apparatus 10, or alternatively the control system 40 may be a computing unit operative for controlling a plurality of different apparatuses in the manufacturing production line. In addition, the control system 40 may be located in proximity to the slot-coating apparatus 10, and connected to the slot-coating apparatus 10 via wire connections, or alternatively, the control system 40 may be located remotely from the slot-coating apparatus 10.

Figure 9:
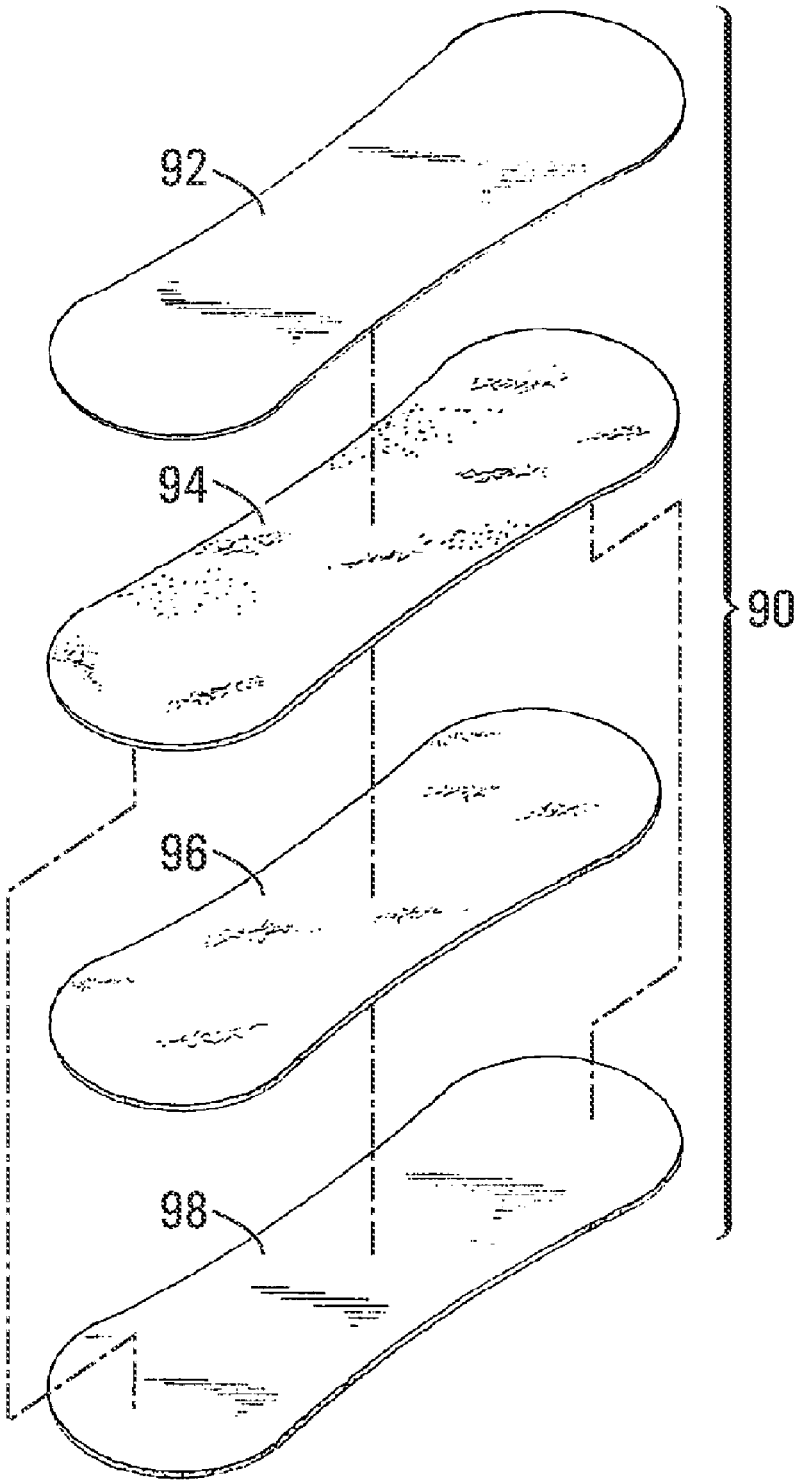
FIG. 9 shows an exploded view of a sanitary napkin in which a substrate of material treated via the slot coating apparatus of the present invention can be incorporated.

As described above, a non-limiting use for the slot-coating apparatus 10 of the present invention is to be incorporated into a production line for manufacturing sanitary absorbent articles, such as sanitary napkins, panty liners, incontinence articles and in some cases, diapers. More specifically, the slot-coating apparatus 10 is used to apply adhesive to a substrate of material that will be incorporated into a sanitary absorbent article. Shown in FIG. 9 is an exploded view of a non-limiting example of a sanitary napkin 90 that can include a layer of material that has been treated by the slot-coating apparatus 10 of the present invention. In the embodiment shown, the sanitary napkin 90 includes a plurality of layers; namely a liquid-pervious, body-facing layer 92, a transfer layer 94, an absorbent core 96 and a liquid-impervious, garment facing layer 98.

The adhesive that is applied to the substrate 14 by the slot-coating apparatus 10 can be positioning adhesive or bonding adhesive. Bonding adhesive is adhesive that is suitable for bonding two layers of material used in the construction of the sanitary absorbent article together. For example, bonding adhesive may be applied to one of the cover layer 92 or the transfer layer 94 for bonding the two layers together. Alternatively, the bonding adhesive may be applied to one of the transfer layer 94 or the absorbent core 98 for bonding these two layers together. Bonding adhesive could also be applied to one of the cover layer 92 or the barrier layer 98 for bonding the outer edges of these two layers together.

Positioning adhesive is adhesive that is suitable for maintaining the sanitary absorbent article in position against a wearer's undergarment, or against a wearer's skin. The positioning adhesive can be either body-attachment adhesive or garment-attachment adhesive depending on whether the sanitary absorbent article is to be applied to either the body facing surface of the cover layer 92, or the garment-facing surface of the barrier layer 98. Each of these embodiments will be described in more detail with respect to FIGS. 10, 11, 12 and 13.

Figure 10:
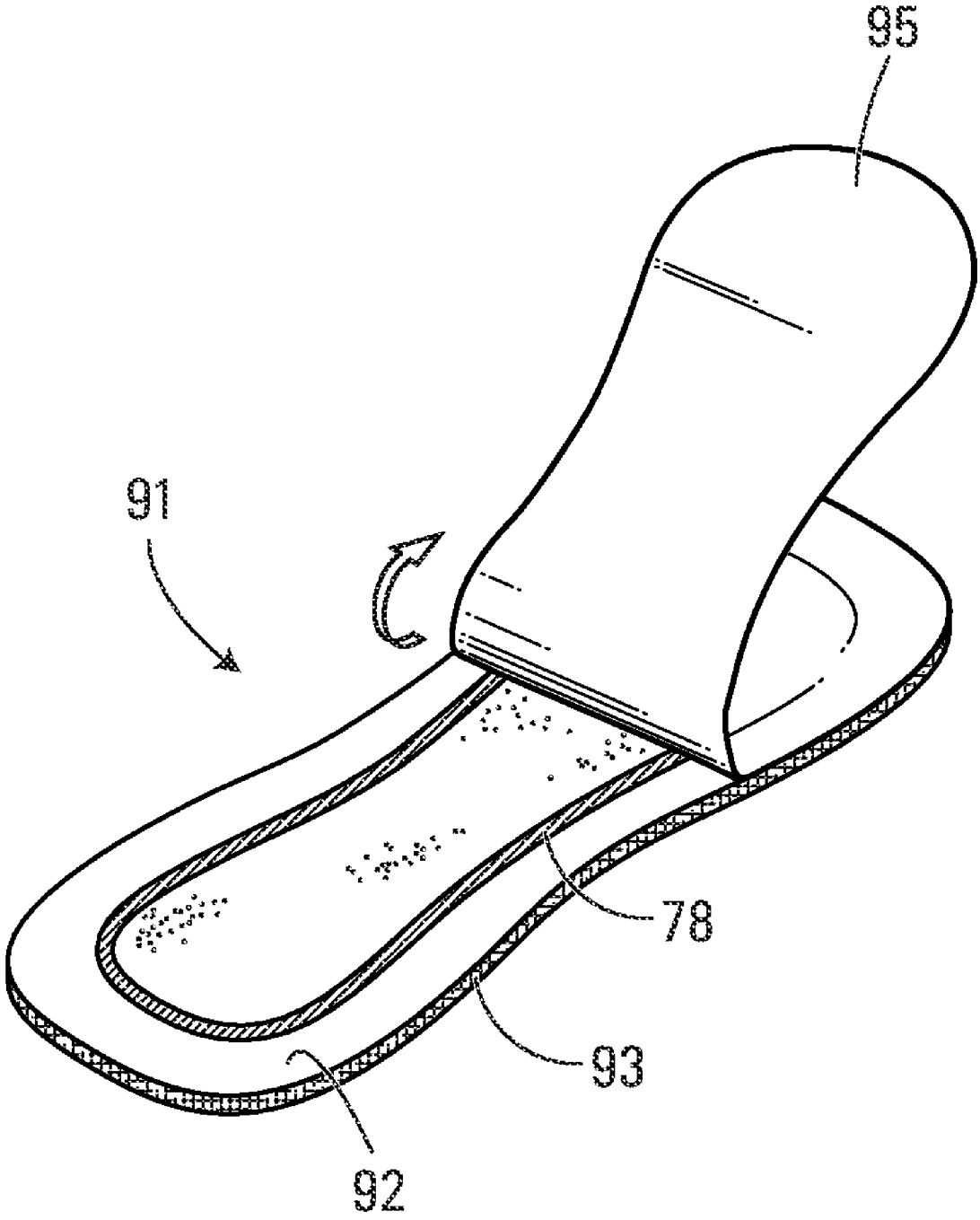
FIG. 10 shows a perspective view of a sanitary napkin including a deposition pattern of adhesive on a body facing surface in accordance with a non-limiting example of implementation of the present invention.

Shown in FIG. 10 is a sanitary napkin 91 in an assembled state, wherein the deposition pattern of adhesive 78 is included on the body facing surface of the cover layer 92. As shown, the sanitary napkin 91 includes a curved outer periphery 93, and the outer boundary 76 of the deposition pattern of adhesive 78 forms a curved line segment. The curved line segment of the deposition pattern of adhesive 78 and the curved outer periphery 93 of the napkin 91 remain at a constant distance from each other. As such, the curved line segment of the deposition pattern 78 substantially follows the curved outer periphery 93 of the napkin 91. It should be appreciated that in an alternative embodiment, the deposition pattern of adhesive 78 may be of a pattern and/or shape that is completely different from the curved outer periphery 93 of the napkin 91.

Figure 13A:
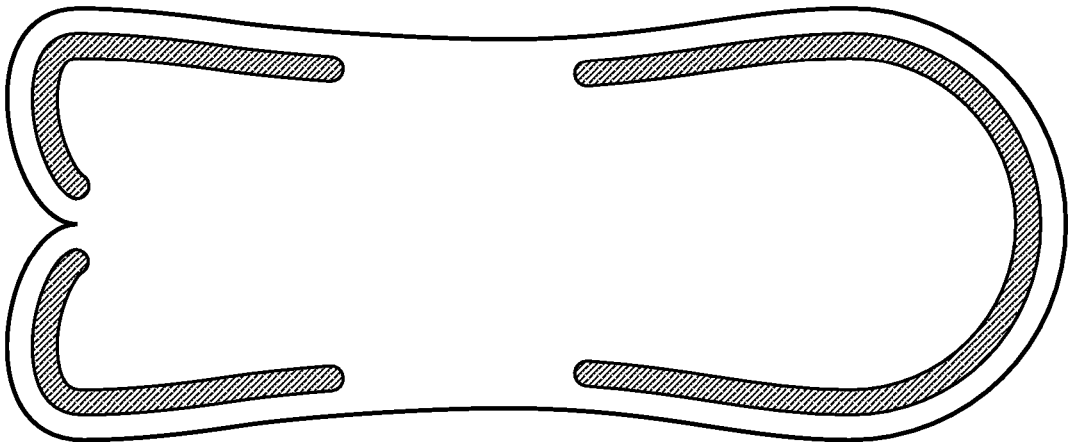
FIGS. 13A-13C show non-limiting examples of different deposition patterns of adhesive that can be applied to a sanitary absorbent article via the slot coating apparatus of the present invention.
Figure 13B:
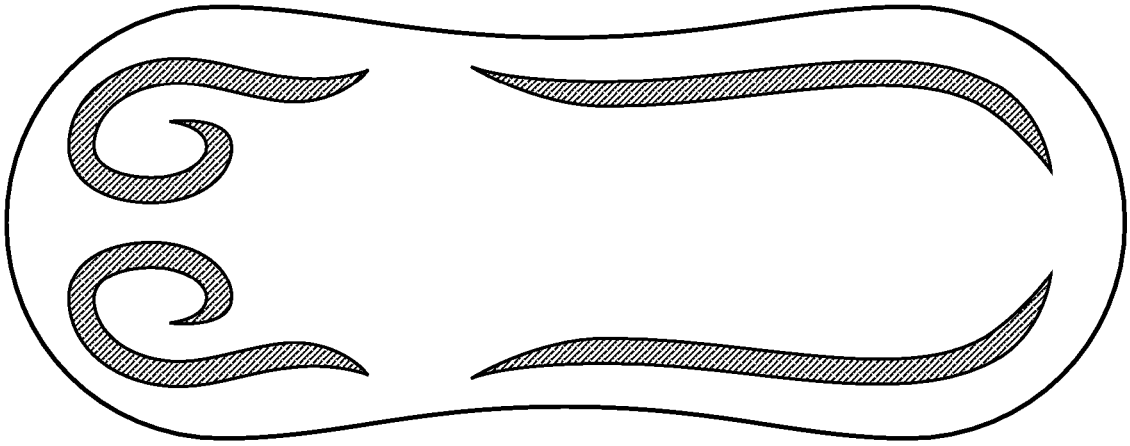
Figure 13C:
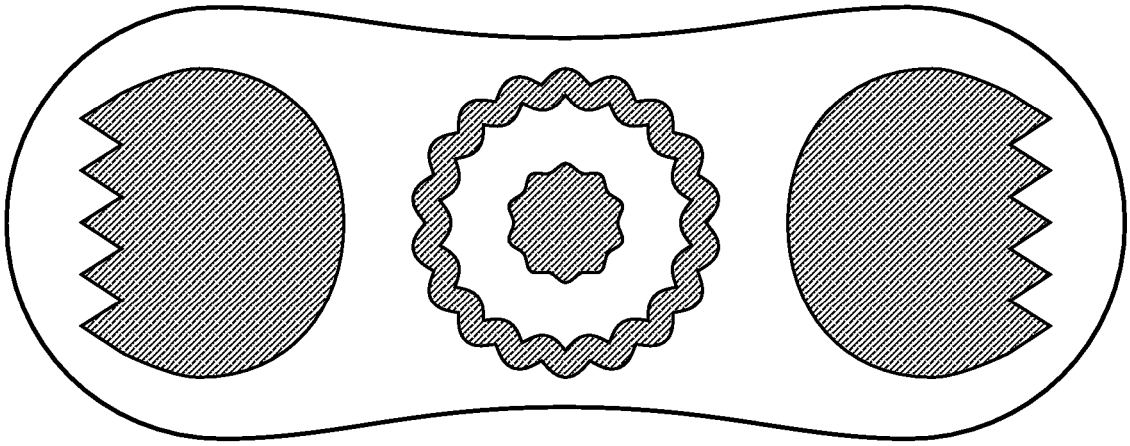

Shown in FIGS. 13A-13C are some non-limiting examples of different patterns of adhesive that can be applied to sanitary absorbent articles by the slot coating apparatus 10 of the present invention. It should be appreciated that the shape and configuration of the different deposition patterns of adhesive are virtually endless.

In order to apply the deposition pattern of adhesive 78 to the cover layer 92 of the sanitary napkin 91, prior to assembling the layers of the napkin 91 together, a large substrate of material suitable for forming the cover layer 92 is conveyed past the slot coating apparatus 10 in the manner shown in FIG. 1. The slot coating apparatus 10 thus applies a series of subsequent deposition patterns to the section of material. The material is then cut into shapes that correspond to the shape of the sanitary napkin 91, such that each cut out shape includes a deposition pattern of adhesive 78 thereon. The cut-out shapes are then integrated into the construction of the sanitary napkin such that the deposition pattern 78 of adhesive is located on the body facing surface of the cover layer 92. A release paper 95 is then positioned over the adhesive deposition pattern 78, and is not removed until a user wishes to apply the sanitary napkin 91 to their body.

Figure 11:
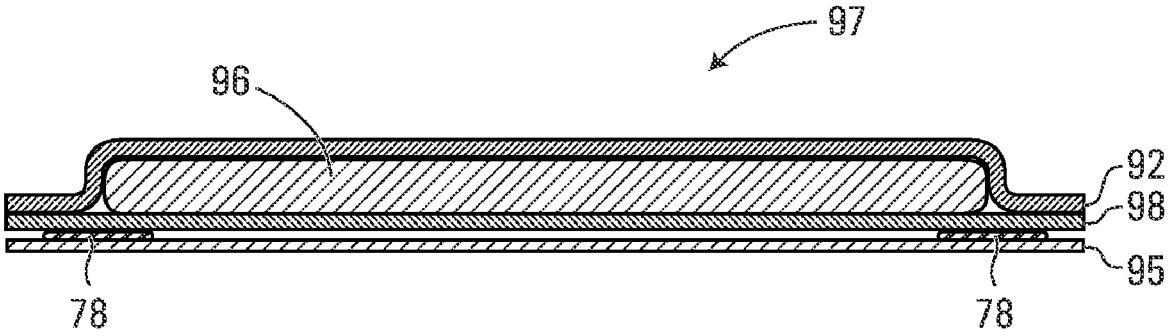
FIG. 11 shows a cross sectional view of a sanitary napkin including a deposition pattern of adhesive on a garment facing surface in accordance with a non-limiting example of implementation of the present invention.

Shown in FIG. 11 is a cross sectional view of a sanitary napkin 97 in an assembled state. In the embodiment shown, the deposition pattern of adhesive 78 is included on the garment facing surface of the barrier layer 98, such that it is operative for securing the sanitary napkin 97 to a wearer's undergarment. Although not shown in FIG. 11, the deposition pattern of adhesive 78 can have an outer boundary that has a line segment remains at a constant distance from a curved outer periphery of the napkin 97. Alternatively, the deposition pattern of adhesive applied to the barrier layer 98 may be of a pattern and/or shape that is completely different from the curved outer periphery 93 of the napkin 91.

In order to apply the deposition pattern of adhesive 78 to the barrier layer 98 of the sanitary napkin 97 as shown in FIG. 11, prior to assembling the layers of the napkin 97 together, a large section of material suitable for forming the barrier layer 98 is conveyed past the slot coating apparatus 10 in the manner shown in FIG. 1. The slot coating apparatus 10 thus applies a series of subsequent deposition patterns to the section of material. The material is then cut into shapes that correspond to the shape of the sanitary napkin 97, such that each cut-out shape includes a deposition pattern of adhesive 78 thereon. The cut-out shapes are then integrated into the construction of the sanitary napkin 97 such that the deposition pattern 78 of adhesive is located on the garment facing surface of the barrier layer 98. A release paper 95 is then positioned over the adhesive deposition pattern 78, and is not removed until a user wishes to apply the sanitary napkin 97 to their undergarment.

Figure 12:
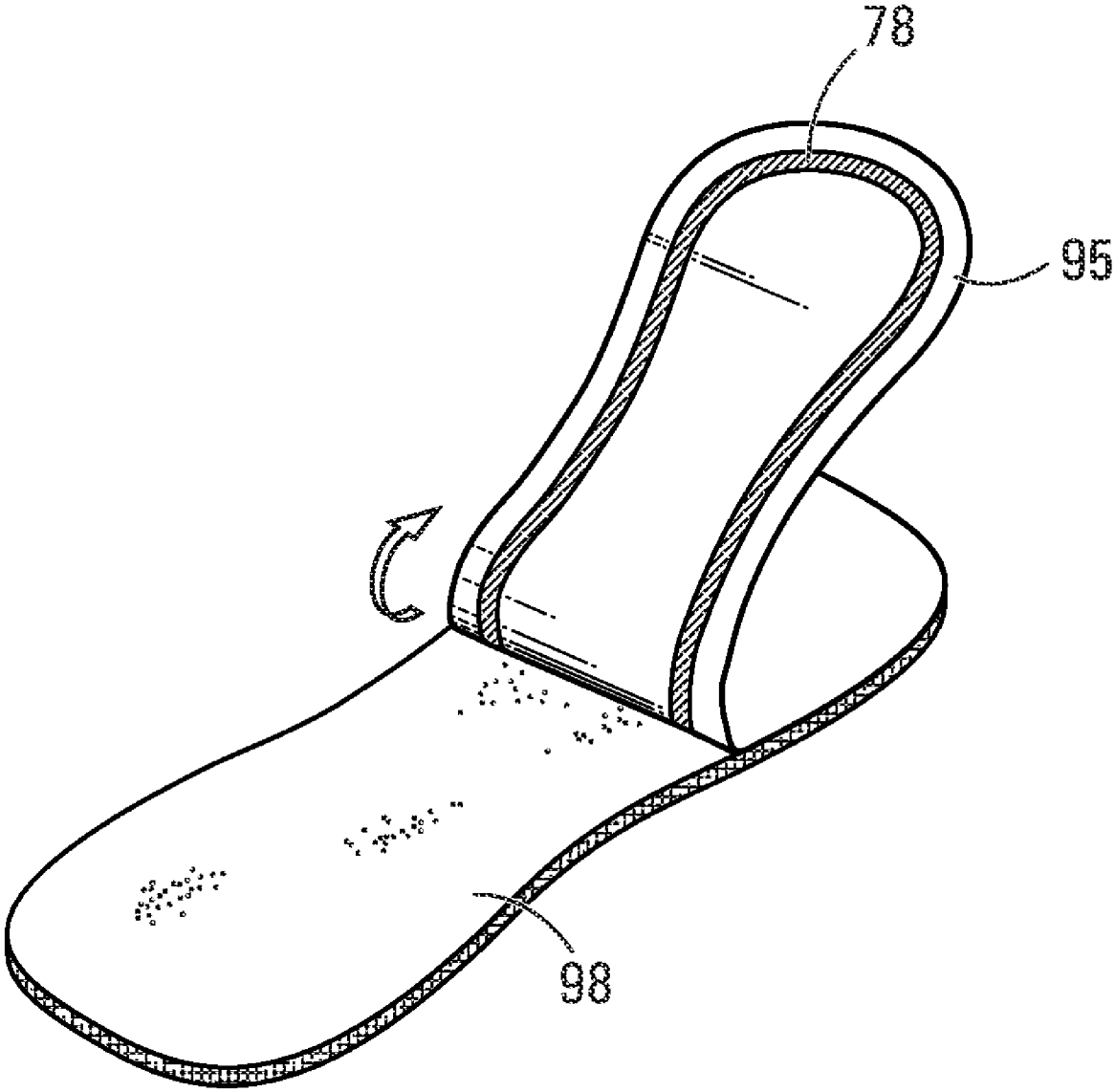
FIG. 12 shows a perspective view of a sanitary napkin wherein the deposition pattern of adhesive is applied to the release paper.

In an alternative embodiment shown in FIG. 12, the deposition pattern 78 of adhesive is applied to the release paper 95, such that the adhesive that has been applied to the release paper 95 is transferred to the garment facing surface of the barrier layer 98 when the release paper 95 is positioned over the barrier layer 98. In such an embodiment, the slot coating apparatus 10 applies the deposition pattern 78 of adhesive to a large sheet of release paper 95, which is then cut into cut-out portions that include thereon a deposition pattern 78 of the adhesive. A carry and place device then transfers the cut-out portions towards the sanitary napkins and places the release paper on the garment facing surface of the barrier layer 98. The release paper 95 is coated with a layer of silicon prior to the release paper 95 being applied thereto, such that once the release paper 95 has been placed on the garment facing surface of the barrier layer 98, the deposition pattern 78 of adhesive is transferred to the barrier layer 98 and remains on the barrier layer 98 even after subsequent removal of the release paper 95.

Although various embodiments have been illustrated, this was for the purpose of describing, but not limiting, the invention. Various modifications will become apparent to those skilled in the art and are within the scope of this invention, which is defined more particularly by the attached claims.

The invention claimed is:

1. An apparatus for surface-to-surface application of an adhesive to a substrate, said apparatus comprising:

a) a housing having an external surface and an outlet;

b) a cylindrical roller rotatably mounted within and enclosed within said housing, said cylindrical roller having an outer surface and an inner cavity for receiving said adhesive, said outer surface including at least one recess in flow communication with said inner cavity such that said adhesive is delivered from said inner cavity to said at least one recess, wherein said cylindrical roller is structured and arranged to rotate within said housing and periodically convey said adhesive through said outlet in said housing to thereby periodically apply to the substrate conveyed past said outlet, in surface to surface contact with said external surface of said housing, said adhesive in a pattern corresponding in shape to said at least one recess.

2. The apparatus according to claim 1, wherein said pattern corresponds to an adhesive pattern for a sanitary absorbent article such that with each revolution of said cylindrical roller an adhesive pattern corresponding to at least one sanitary absorbent article is applied to the substrate.

3. The apparatus according to claim 1, wherein said at least one recess includes a bottom surface, said bottom surface including a plurality of throughbores in flow communication with said inner cavity for delivering liquid media from said inner cavity to said at least one recess.

4. The apparatus according to claim 3, further comprising a gasket arranged around an edge of said recess for preventing the flow of said liquid media beyond said edge of said at least one recess.

5. The apparatus according to claim 1, wherein said substrate is suitable for forming a garment facing layer of a sanitary absorbent article.

6. The apparatus according to claim 5, wherein said adhesive is suitable for use as a garment attachment adhesive of a sanitary absorbent article.

7. The apparatus according to claim 1, wherein said substrate is suitable for forming a body facing layer of a sanitary absorbent article.

8. The apparatus according to claim 7, wherein said adhesive is suitable for use as a body attachment adhesive of a sanitary absorbent article.

* * * * *